US005913596A

United States Patent [19]

Lin

[11] Patent Number: 5,913,596

[45] Date of Patent: Jun. 22, 1999

[54] MULTIFUNCTIONAL SCREWDRIVER

[76] Inventor: Wan-Chang Lin, No. 3, Industrial 15th Rd., Ta-Li Industrial Zone,Taiping Hsiang, Taichung, Taiwan

[21] Appl. No.: 09/119,216

[22] Filed: Jul. 20, 1998

[51] Int. Cl.[6] ..... B25B 23/18

[52] U.S. Cl. ..... 362/120; 362/109; 362/234

[58] Field of Search ..... 362/109, 119, 362/120, 234, 253

[56] References Cited

U.S. PATENT DOCUMENTS 3,919,541 11/1975 Chao ..... 362/120

5,690,414 11/1997 Jeng ..... 362/120

*Primary Examiner*—Stephen Husar

*Attorney, Agent, or Firm*—W. Wayne Liauh

[57] ABSTRACT

A multifunctional screwdriver is composed of a handle, a shank, a lighting fixture base, and a tip retaining seat. The handle is provided in the rear end thereof with a battery seat for mounting batteries and is fastened in the front end thereof with the shank which is provided therein with an expandable rod having a magnet fastened with one end thereof and a ratchet wheel fastened with another end thereof for controlling the rotational direction of the shank. The lighting fixture base is fastened with the front end of the handle such that the lighting fixture base is connected with the battery seat. The tip retaining seat is provided with a plurality of slots for holding a plurality of tips of various specification. The multifunctional screwdriver can be used as a screwdriver, a lighting device, and a handy device for picking up metal pieces.

1 Claim, 10 Drawing Sheets

MULTIFUNCTIONAL SCREWDRIVER

FIELD OF THE INVENTION

The present invention relates generally to a screwdriver, and more particularly to a multifunctional screwdriver.

BACKGROUND OF THE INVENTION

As shown in FIG. 1, a prior art multifunctional screwdriver is composed of a plurality of tips 1 of various sizes and forms, a handle 2, and a shank 4. The shank 4 is fastened at one end thereof with the handle 2. The shank 4 has a free end which is engageable with the tips 1. The handle 2 is provided at the free end thereof with a receiving slot 3 for keeping the tips 1.

As shown in FIG. 2, another prior art multifunctional screwdriver is composed of a receiving slot 5 in which two batteries 6 are provided such that the batteries 6 are connected with a bulb 8 by means of a conductive piece 7. The receiving slot 5 is incapable of accommodating a plurality of tips 9 of various sizes and forms. As a result, the tips 9 must be kept separately.

SUMMARY OF THE INVENTION

The primary objective of the present invention is to provide a multifunctional screwdriver which is provided with a lighting fixture as well as a plurality of tips.

The foregoing objective and the features of the present invention will be readily understood upon a thoughtful deliberation of the following detailed description of the present invention with reference to the accompanying drawings.

DETAILED DESCRIPTION OF THE INVENTION

Figure 1:
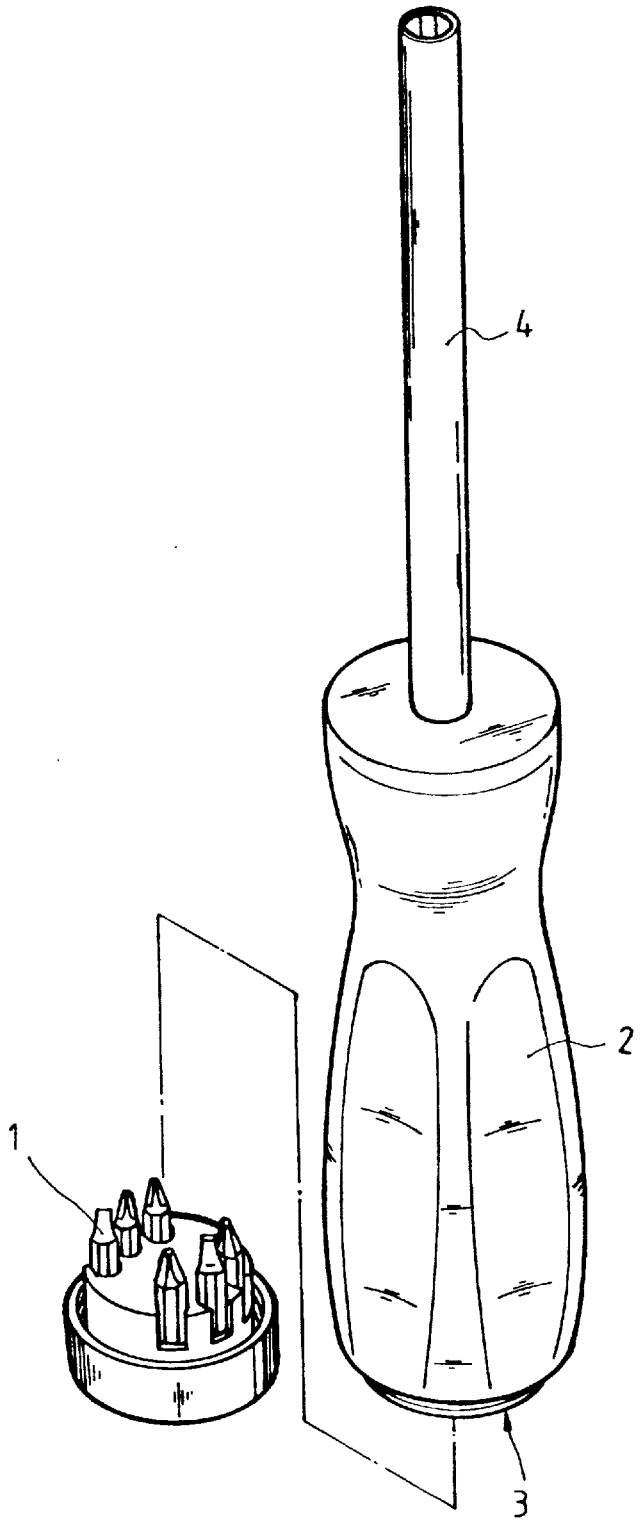
Fig. 1 PRIOR ART
FIG. 1 shows a schematic view of a prior art multifunctional screwdriver.
Figure 2:
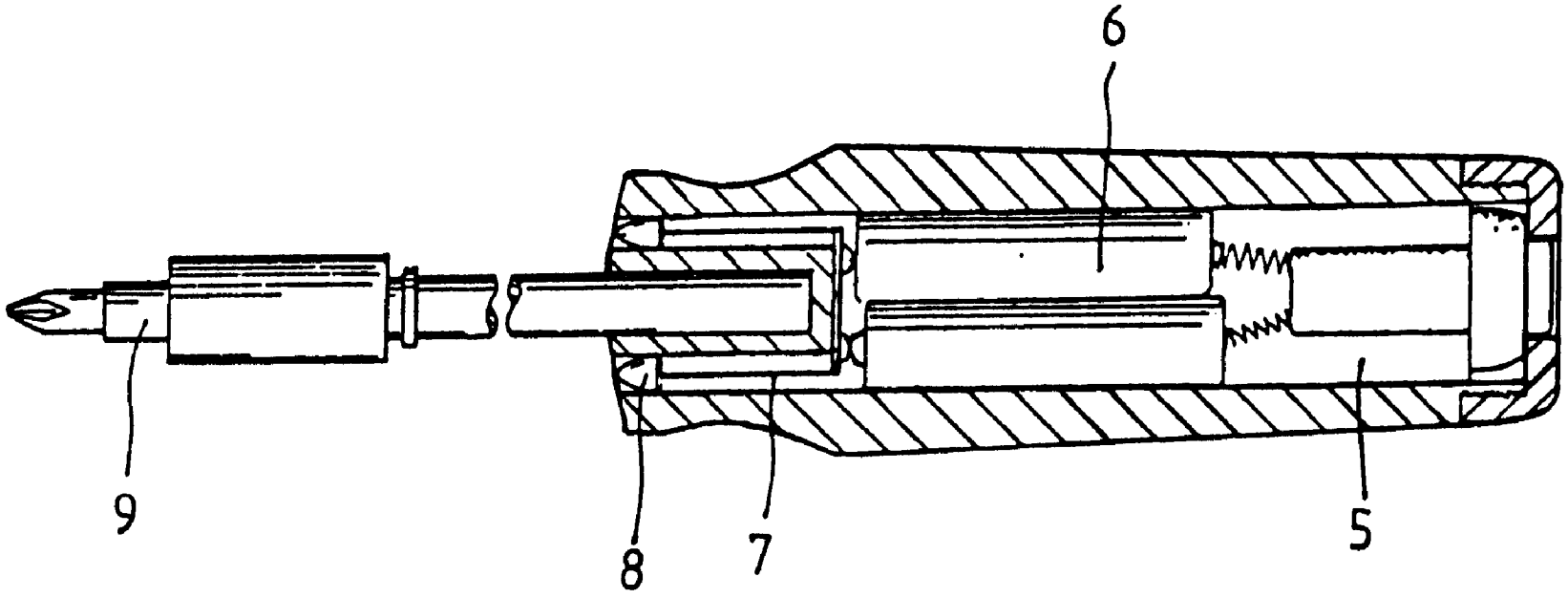
Fig. 2 PRIOR ART
FIG. 2 shows a perspective view of another prior art multifunctional screwdriver.
Figure 3:
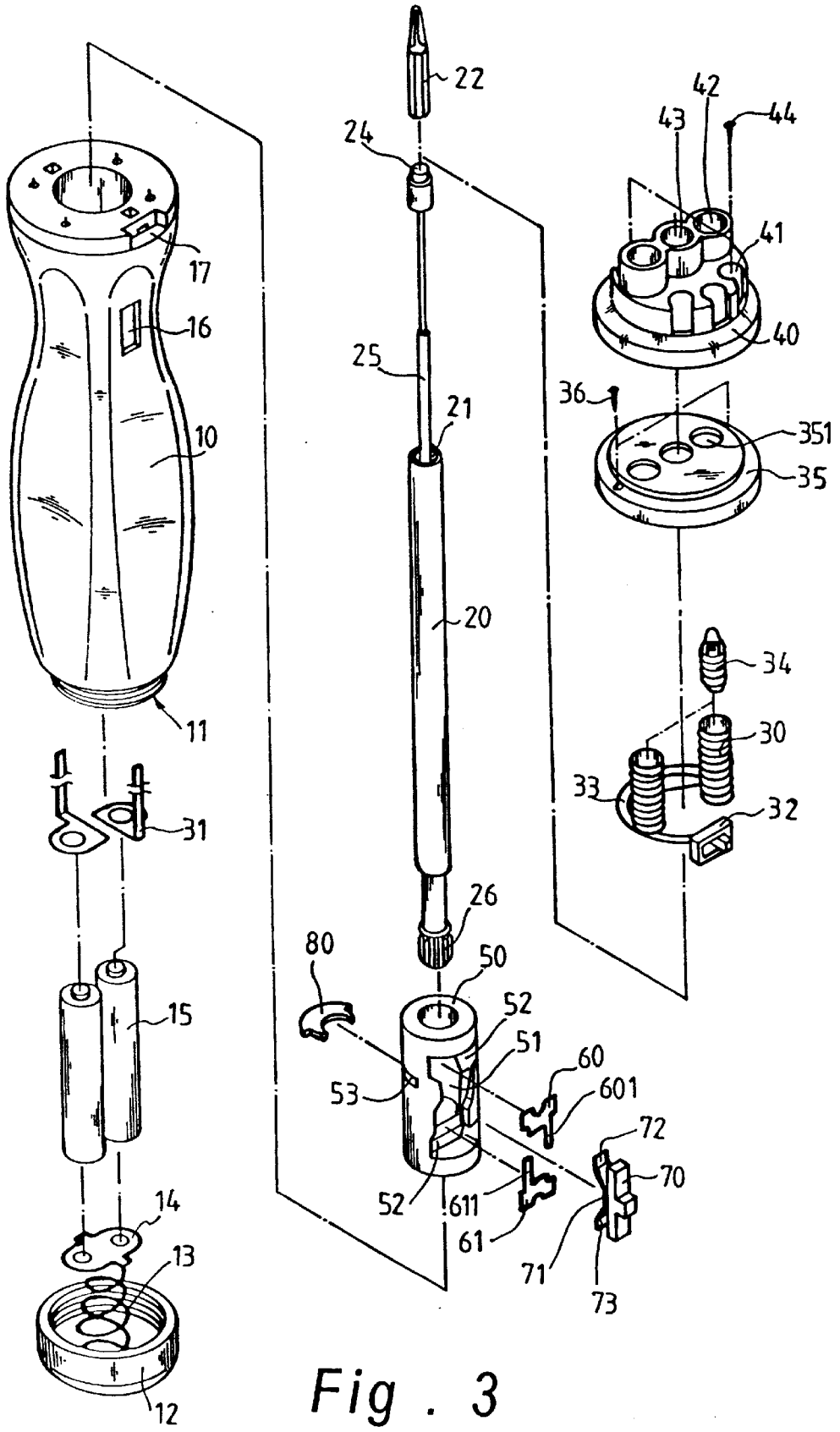
FIG. 3 shows an exploded view of a multifunctional screwdriver of the present invention.
Figure 4:
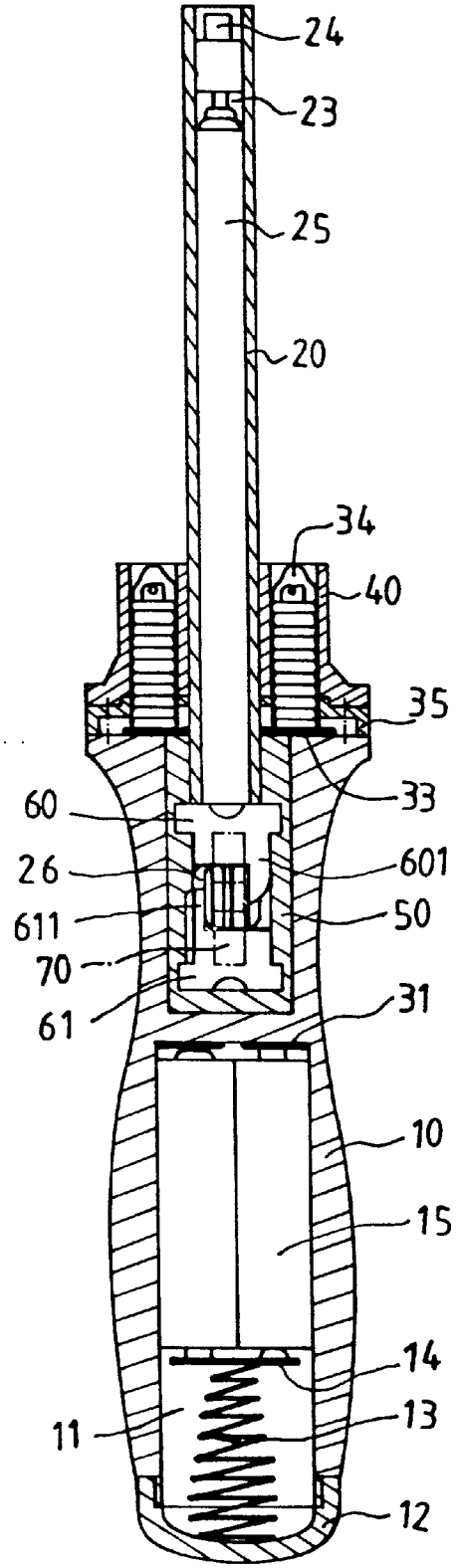
FIG. 4 shows a longitudinal sectional view of the multifunctional screwdriver of the present invention.
Figure 5:
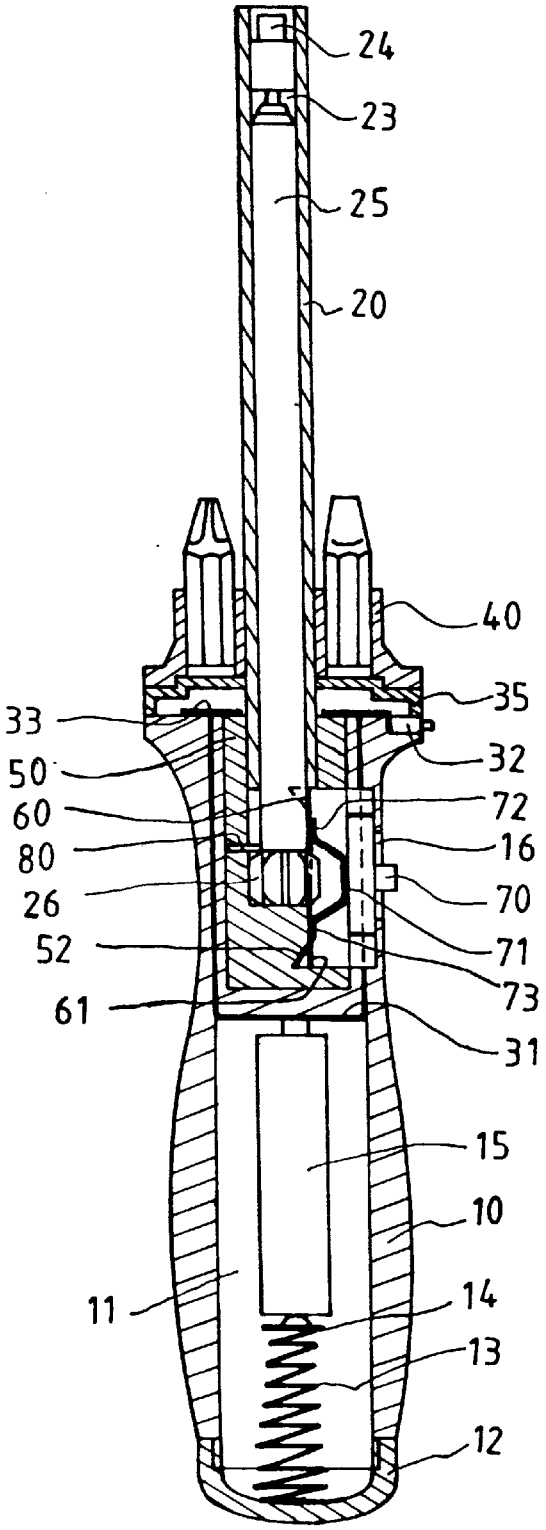
FIG. 5 shows another longitudinal sectional view of the multifunctional screwdriver of the present invention.
Figure 6:
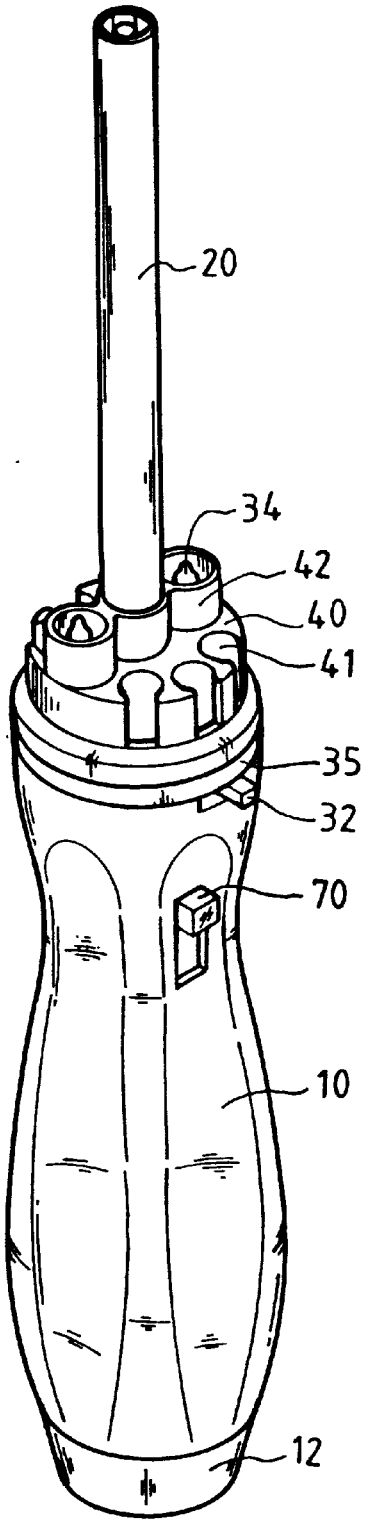
FIG. 6 shows a perspective view of the present invention.
Figure 7:
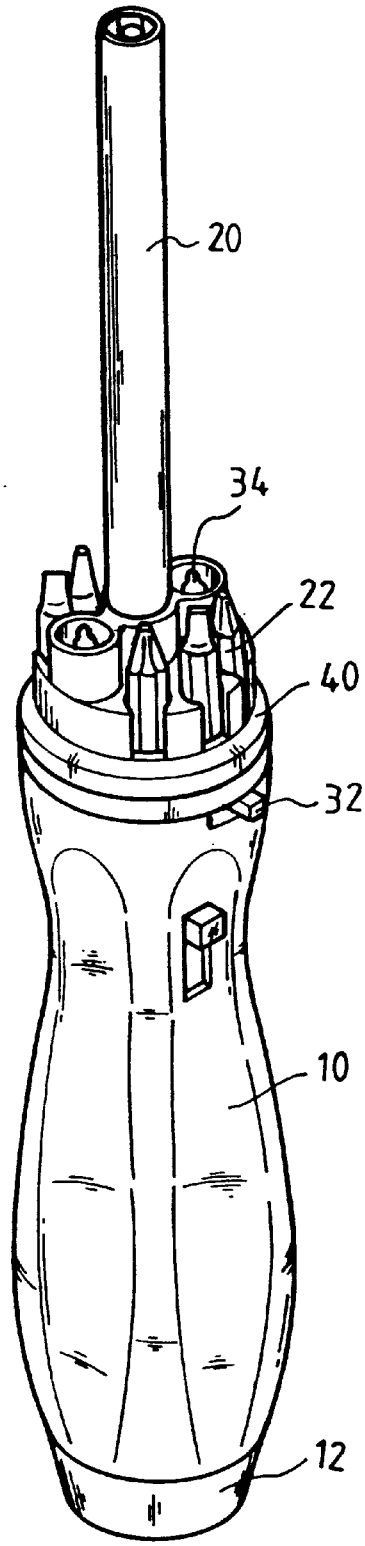
FIGS. 7–10 show schematic views of the present invention in use.
Figure 8:
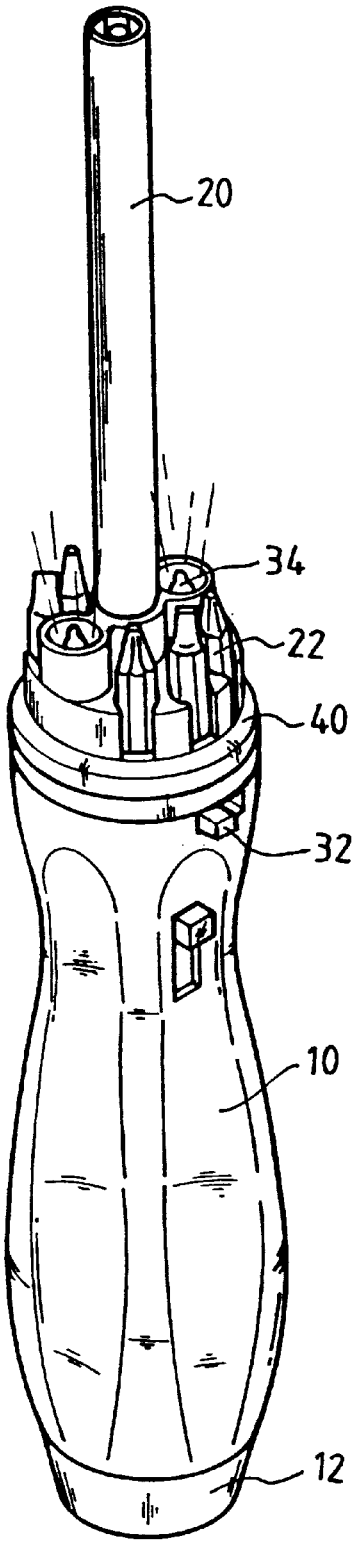

As shown in FIGS. 3–6, a multifunctional screwdriver embodied in the present invention is composed of a handle 10, a shank 20, a lighting fixture base 30, and a fitting base 40.

The handle 10 is provided at the rear end thereof with a battery seat 11, a rotary cap 12 which is engaged with the rear end of the handle 10 in conjunction with a spring 13, a metal connection piece 14, and two batteries 15 which are located in the handle 10.

Figure 9:
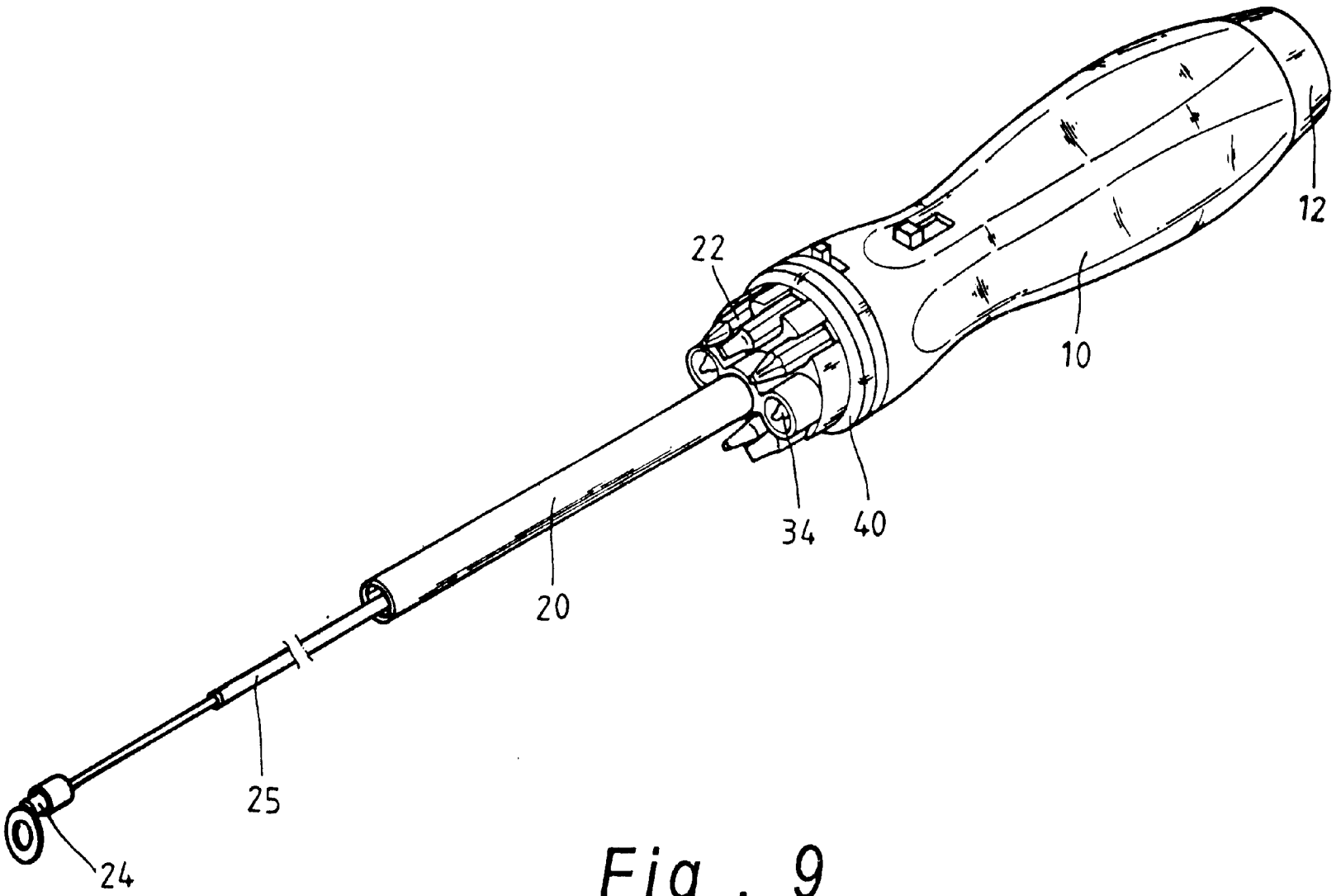
Figure 10:
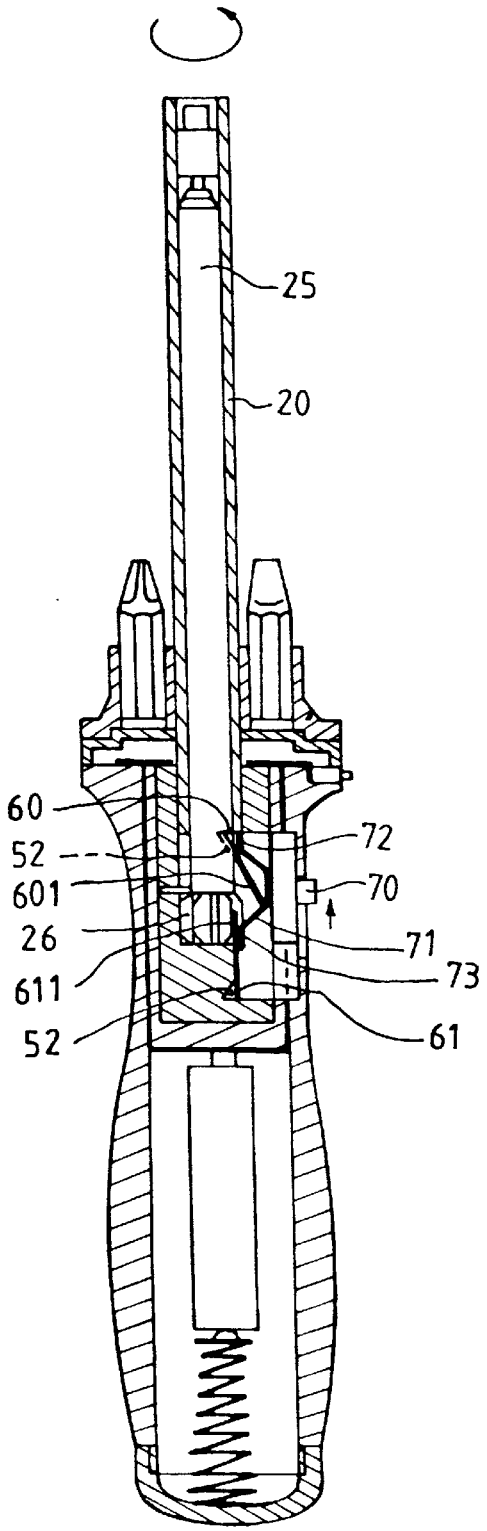

The shank 20 is provided at one end thereof with a hexagonal hole 21 which is engaged with a tip 22. The shank 20 is provided with a through hole 23 extending along the direction of the longitudinal axis of the shank 20. The through hole 23 is intended to accommodate an expandable rod. 25 which is provided at one end thereof with a magnet 24 fastened therewith and is provided at another end thereof with a ratchet wheel 26 fastened therewith such that the ratchet wheel 26 is received in a cylindrical tube 50. The cylindrical tube 50 of a hollow construction is provided with an open portion 51 in which two retaining pieces 60 and 61 are located. The retaining pieces 60 and 61 are respectively provided with a confining portion 601, 611, which are located oppositely at two sides of the ratchet wheels 26. The cylindrical tube 50 is further provided therein with a control switch 70 having an elastic piece 71. The elastic piece 71 is provided with two press portions 72 and 73, which are respectively joined with the two retaining pieces 60 and 61. The cylindrical tube 50 is still further provided with an inclined surface 52 opposite in location to the retaining pieces 60 and 61. The cylindrical tube 50 is engaged at one end thereof with the handle 10 such that the control switch 70 is received in a receiving slot 16 of the handle 10 in a way that the control switch 70 is partially jutted out of the receiving slot 16. The control switch 70 is intended to control the rotational direction of the shank 20. The cylindrical tube 50 is provided with an indentation 53 located over the ratchet wheel 26 for locating a retaining piece 80 intended to fasten the shank 20 and the cylindrical tube 50. The lighting fixture base 30 is connected with the batteries 15 by means of two conductive pieces 31. The lighting control is attained by a switch 32 which is located in a slot 17 of the handle 10. The lighting fixture base 30 is connected with the switch 32 by a connection piece 33. A bulb 34 is mounted on the lighting fixture base 30 such that the bulb 34 is put through a through hole 351 of a cover 35 which is fastened with the handle 10 by a plurality of screws 36. A tip-retaining seat 40 is provided with a plurality of retaining slots 41 for retaining tips of various specifications and is further provided with a fitting hole 42 and a through hole 43. The shank 20 is put through the through hole 43 such that the bulb 34 and the lighting fixture base 30 are fitted into the fitting holes 42. The tip retaining seat 40 is fastened with the handle 10 by a screw 44. The shank 20 can be used for holding the tip and for lighting. As illustrated in FIG. 9, the expandable rod 25 can be extended to pick up a metal piece which can not be reached by hand, thanks to the magnet 24 which is fastened with the top end of the expandable rod 25. The ratchet wheel 26 can be actuated by the control switch 70 to free the retaining piece 60 so as to enable the expandle rod 25 to actuate the shank 20 to turn unidirectionally.

The embodiment of the present invention described above is to be regarded as being merely illustrative and not restrictive. Accordingly, the present invention may be embodied in other specific forms without deviating from the spirit thereof. The present invention is therefore to be limited only by the scope of the following appended claim.

What is claimed is:

1. A multifunctional screwdriver comprising:

(a) a handle being provided at one end thereof with a battery seat for mounting batteries and at another end thereof with a rotary cover fastened therewith in conjunction with a spring and a connection piece, said handle further being provided with a slot and a retaining slot;

(b) a shank being provided at one end thereof with a hexagonal hole for engaging with a tip, said shank further being provided with a through hole for receiving an expandable rod having a magnet attached to one end thereof, said expandable rod further having a ratchet wheel fastened to another end thereof, said shank being fastened with a cylindrical tube which is received in said handle and is provided with a retaining piece having a confining portion, said retaining piece being controlled by a control switch for controlling a rotational direction of said shank;

(c) a lighting fixture base fastened to one end of said handle and connected with said battery seat by a conductive piece, said lighting fixture base being fastened to a cover for confining said connection piece and said cylindrical tube, said lighting fixture base further being provided with a switch located in a slot of said handle for controlling a power supply, said lighting fixture base still further being provided with a bulb mounted thereon; and (d) a tip retaining seat being provided with a plurality of retaining slots, a through hole and a fitting hole, said plurality of retaining slots being constructed for holding a plurality of tips of various specifications, respectively, said tip retaining seat being fastened to one end of said handle in such a manner that said shank is disposed through said through hole, and that said lighting fixture base is fitted into said fitting hole.

* * * * *